US008905866B2

(12) United States Patent
Nakagawa et al.

(10) Patent No.: US 8,905,866 B2
(45) Date of Patent: Dec. 9, 2014

(54) METHOD FOR ARRANGING DIMPLES ON GOLF BALL SURFACE

(75) Inventors: Takuma Nakagawa, Chichibu (JP); Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 685 days.

(21) Appl. No.: 13/163,016

(22) Filed: Jun. 17, 2011

(65) Prior Publication Data

US 2012/0322584 A1 Dec. 20, 2012

(51) Int. Cl.
*A63B 37/12* (2006.01)
*A63B 37/00* (2006.01)

(52) U.S. Cl.
CPC ..... *A63B 37/0006* (2013.01); *A63B 37/0003* (2013.01); *A63B 37/002* (2013.01); *A63B 37/0021* (2013.01)
USPC ..... 473/378; 473/383

(58) Field of Classification Search
USPC ..... 473/378–384
See application file for complete search history.

(56) References Cited

U.S. PATENT DOCUMENTS

| | | | | |
|---|---|---|---|---|
| 4,560,168 | A | 12/1985 | Aoyama | |
| 5,527,043 | A * | 6/1996 | Shimosaka | 473/384 |
| 5,688,193 | A * | 11/1997 | Kasasima et al. | 473/379 |
| 5,688,194 | A * | 11/1997 | Stiefel et al. | 473/383 |
| 5,772,532 | A * | 6/1998 | Stiefel et al. | 473/384 |
| 6,234,917 | B1 | 5/2001 | Asakura | |
| 6,254,496 | B1 * | 7/2001 | Maehara et al. | 473/378 |
| 6,435,988 | B2 * | 8/2002 | Maehara et al. | 473/378 |
| 2002/0019275 | A1 * | 2/2002 | Winfield et al. | 473/378 |
| 2003/0211903 | A1 * | 11/2003 | Hanada et al. | 473/378 |
| 2005/0176525 | A1 * | 8/2005 | Nardacci | 473/378 |

FOREIGN PATENT DOCUMENTS

| | | | |
|---|---|---|---|
| JP | 60-234674 | A | 11/1985 |
| JP | 7-178198 | A | 7/1995 |
| JP | 9-028833 | A | 2/1997 |
| JP | 9-164223 | A | 6/1997 |
| JP | 11-137721 | A | 5/1999 |
| JP | 2000-189542 | A | 7/2000 |

* cited by examiner

*Primary Examiner* — Kurt Fernstrom
*Assistant Examiner* — John E Simms, Jr.
(74) *Attorney, Agent, or Firm* — Sughrue Mion, PLLC

(57) ABSTRACT

A method for arranging dimples on a golf ball surface includes: determining an initial arrangement of dimples; dividing the surface of a golf ball into multiple equivalent unit regions; based on a dimple interval between two freely selected dimples within one of the unit regions, determining whether or not the two dimples are in an adjacent relationship to each other; and changing the positions of the two dimples corresponding to the dimple interval between the two freely selected dimples in the adjacent relationship, wherein determining of the adjacent relationship and changing of the position are repeated until the maximum interval, which is a maximum value of the dimple interval between two freely selected dimples in the adjacent relationship in the unit region, falls below a predetermined value.

5 Claims, 8 Drawing Sheets

Min 0.017
Ave 0.034
Max 0.017
DIMPLE INTERVAL [mm]

Min 0.004
Ave 0.006
Max 0.007
DIMPLE INTERVAL [mm]

| | |
|---|---|
| Spaces | |
| Min | 0.000 |
| Ave | 0.002 |
| Max | 0.005 |
| Ball Data | |
| | 338 |
| SR | 90.06% |
| AveR | 4.39 |

METHOD FOR ARRANGING DIMPLES ON GOLF BALL SURFACE

BACKGROUND OF THE INVENTION

1. Field of the Invention

The present invention relates to a method for arranging dimples on a golf ball surface, and to a golf ball realized according to the same method.

2. Description of Related Art

As a method for arranging dimples on a golf ball surface, there have been known methods for arranging the dimples on a regular polyhedron such as a regular octahedron, and a regular icosahedron. Additionally, there have also been methods known in which the spherical surface of a golf ball is divided into multiple regions and dimples are arranged on the respective regions such that they are rotationally symmetrical with respect to a central axis of the golf ball. For example, those methods include Japanese Unexamined Patent Application Publication No. S60-234674, Japanese Unexamined Patent Application Publication No. H7-178198, Japanese Unexamined Patent Application Publication No. H9-28833 and Japanese Unexamined Patent Application Publication No. H11-137721.

Methods for calculation to arrange dimples on the golf ball surface at random are disclosed in Japanese Unexamined Patent Application Publication No. 2000-189542 and Japanese Unexamined Patent Application Publication No. H9-164223.

SUMMARY OF THE INVENTION

According to Japanese Unexamined Patent Application Publication No. S60-234674, Japanese Unexamined Patent Application Publication No. H7-178198, Japanese Unexamined Patent Application Publication No. H9-28833, and Japanese Unexamined Patent Application Publication No. H11-137721, the size and shape of dimples to be arranged are limited to particular types, and therefore, there exists a limitation in arrangement of dimples to ensure an equal distance between adjacent dimples.

Although Japanese Unexamined Patent Application Publication No. 2000-189542 and Japanese Unexamined Patent Application Publication No. H9-164223 aim at improving the surface occupation ratio, the inventions presented by the above-mentioned proposals cannot always ensure an equal interval between adjacent dimples even if the improvement of the surface occupation ratio is achieved.

Accordingly, the present invention intends to equalize intervals between adjacent dimples by, first, arranging the dimples temporarily on a golf ball surface and then adjusting positions of the dimples.

To achieve the above-described object, a method for determining an arrangement of dimples on the golf ball surface according to the present invention, includes: an initial arrangement determining step for determining an initial arrangement of dimples on the surface of a golf ball; a unit region dividing step for dividing the surface of a golf ball into multiple equivalent unit regions; an adjacent relationship determining step for, based on a dimple interval between two freely selected dimples within one of the unit regions, determining whether or not the two dimples are in an adjacent relationship to each other; and a position changing step of changing the initial arrangement by changing the positions of the two dimples corresponding to the dimple interval between the two freely selected dimples in the adjacent relationship, in which the adjacent relationship determining step and the position changing step are repeated until the maximum interval, which is a maximum value of the dimple interval between the two freely selected dimples in the adjacent relationship in the unit region, falls below a predetermined value.

According to an embodiment of the method for determining an arrangement of dimples on the golf ball surface, when the dimple interval between the two freely selected dimples is equal to or less than a specific interval obtained by multiplying the diameter or radius of one of the dimples by a certain coefficient in the adjacent relationship determining step, it is determined that the two dimples are in an adjacent relationship to each other.

According to another embodiment of the method for determining an arrangement of dimples on the golf ball surface, preferably, the coefficient by which to multiply the radius is 0.2 to 1.3, more preferably 0.3 to 1.2.

According to another embodiment of the method for determining an arrangement of dimples on the golf ball surface, the method for determining an arrangement of dimples on the golf ball surface further includes a size changing step of, after the position changing step, changing the sizes of the two dimples whose positions are already changed in the position changing step.

According to another embodiment of the method for determining an arrangement of dimples on the golf ball surface, the method for determining an arrangement of dimples on the golf ball surface further includes a degree-of-symmetry evaluating step of, after the position changing step, selecting at least two axes passing the center of a golf ball, acquiring a summation of products of a distance from the center of each dimple located on the golf ball up to the axis and a virtual spherical surface area of the dimple, for each axis, and based on a ratio between a summation acquired about an axis and a summation acquired about another axis, evaluating the degree of symmetry of the dimples arranged on the entire golf ball surface.

To achieve the above-described object, the golf ball of the present invention has dimples based on a dimple arrangement determined by the method for determining an arrangement of dimples on the golf ball surface.

According to content disclosed in this patent application, the intervals between the dimples arranged on the golf ball surface can be equalized as much as possible.

DETAILED DESCRIPTION OF THE PREFERRED EMBODIMENTS

Figure 1:
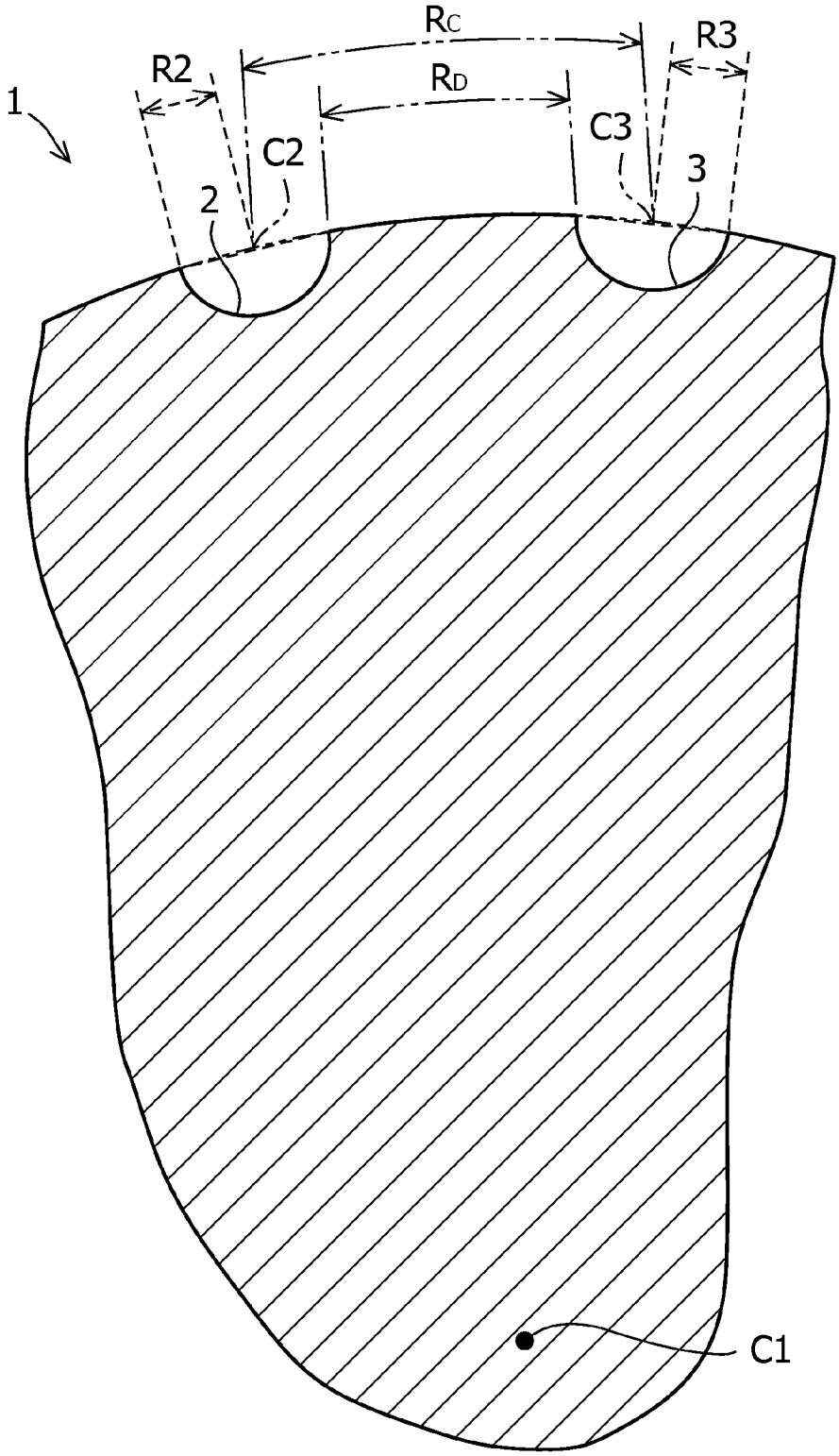
FIG. 1 is a partial sectional view of a golf ball for explaining technical terms for use in this specification.

First, terms for use in this specification will be explained with reference to FIG. 1. FIG. 1 shows a partial sectional view of a golf ball 1. A dimple 2 and a dimple 3 exist on the surface of the golf ball 1. The center of a virtual spherical surface of the dimple 2 is expressed as C2 and this is called the center of dimple 2. A radius R2 of a planar circle formed by an edge of the dimple 2 is called the radius of dimple 2. The same is also applied to the dimple 3. That is, the center of the dimple 3 is expressed as C3 and the radius of the dimple 3 is called R3.

When thinking with respect to the center C1 of the golf ball 1, a length $R_C$ of an arc of a circle, drawn between the center C2 of the dimple 2 and the center C3 of the dimple 3, is called between-dimples distance between the dimple 2 and the dimple 3. Furthermore, a length $R_D$, which is the between-dimples distance $R_C$ minus the radius R2 of the dimple 2 and the radius R3 of the dimple 3, is called the dimple interval.

Figure 2:
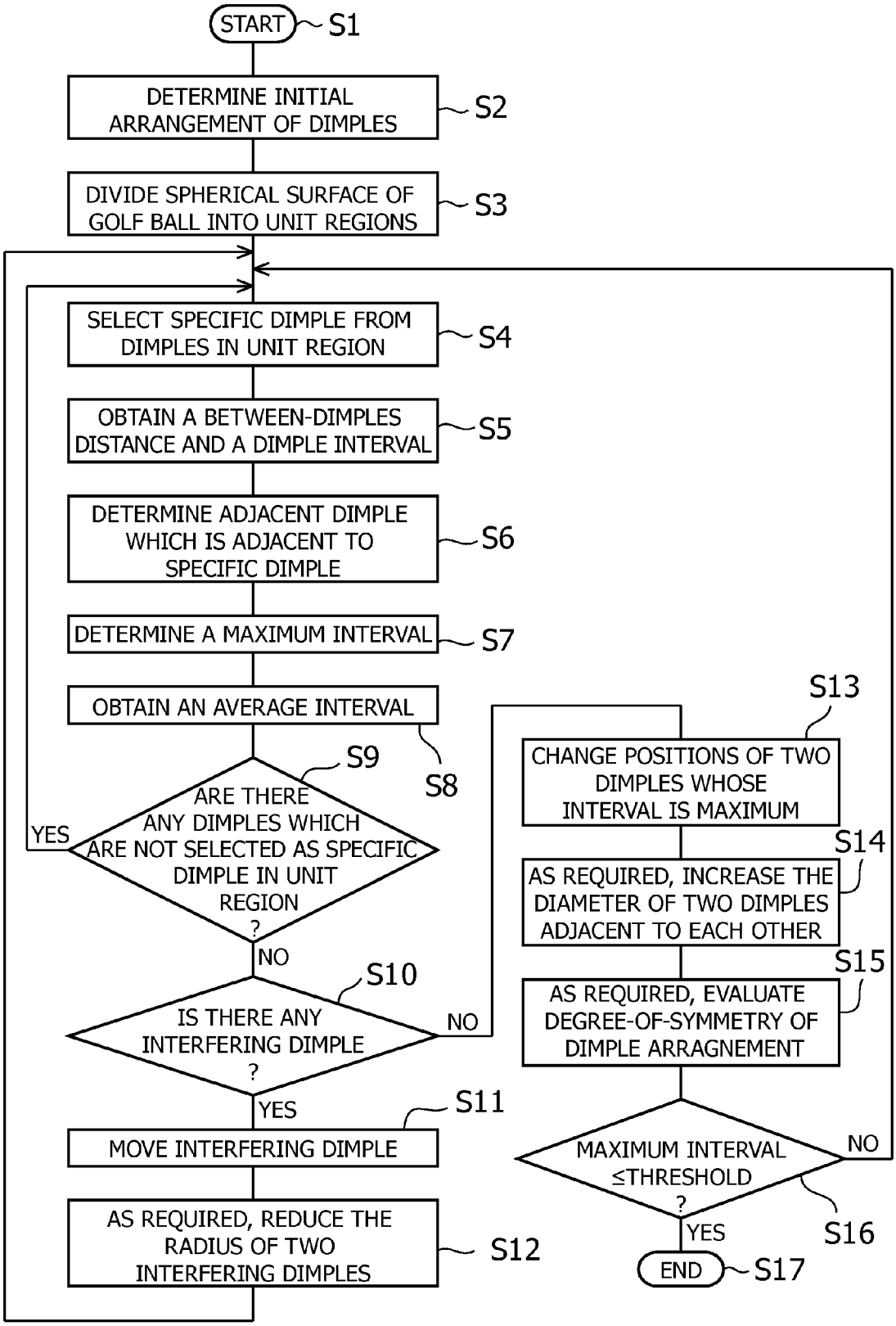
FIG. 2 is a flow chart of a processing for determining arrangement of dimples which is carried out by a dimple arrangement determining apparatus.

Based on such definitions of the terms for use in this specification, a processing for determining an arrangement of the dimples will be described specifically with reference to FIGS. 2 to 4. FIG. 2 is a flow chart showing an example of the processing for determining the arrangement of the dimples. This processing will be executed by a dimple arrangement determining apparatus 5 shown in FIGS. 3 and 4.

Figure 3:
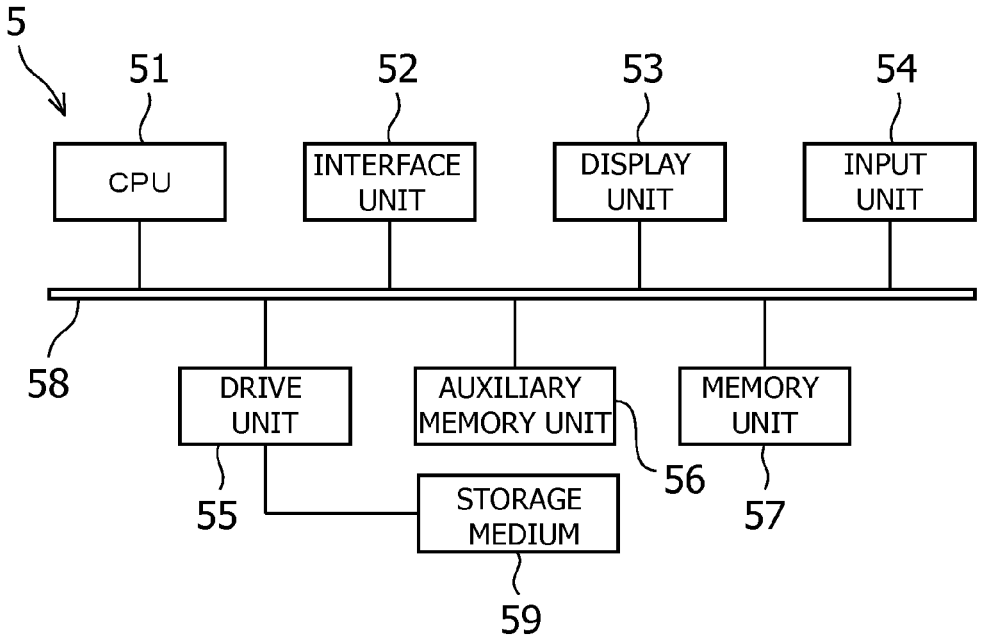
FIG. 3 is an explanatory view showing an example of the configuration of hardware for the dimple arrangement determining apparatus.

FIG. 3 shows an example of the hardware configuration of the dimple arrangement determining apparatus 5. The dimple arrangement determining apparatus 5 includes a CPU 51, an interface unit 52, a display unit 53, an input unit 54, a drive unit 55, an auxiliary storage unit 56 and a memory unit 57, which are all connected mutually via a bus 58.

A program for achieving the processing shown in FIG. 2 is provided by a storage medium 59 such as a CD-ROM. When the storage medium 59 storing the program is set in the drive unit 55, the program is installed into the auxiliary storage unit 56 from the storage medium 59 via the drive unit 55. Alternatively, installation of the program does not always need to be executed through the storage medium 59, but the program may be downloaded from another computer via a network. The auxiliary storage unit 56 stores the installed program and necessary files and data.

When a program startup instruction is given, the memory unit 57 reads out the program from the auxiliary storage unit 56 and stores it therein. The CPU 51 realizes the function of the dimple arrangement determining apparatus 5 according to a program stored in the memory unit 57. The interface unit 52 is used to connect the dimple arrangement determining apparatus 5 to another computer via a network. The display unit 53 displays graphical user interface (GUI) and the like based on the program. The input unit 54 includes a keyboard and a mouse.

Figure 4:
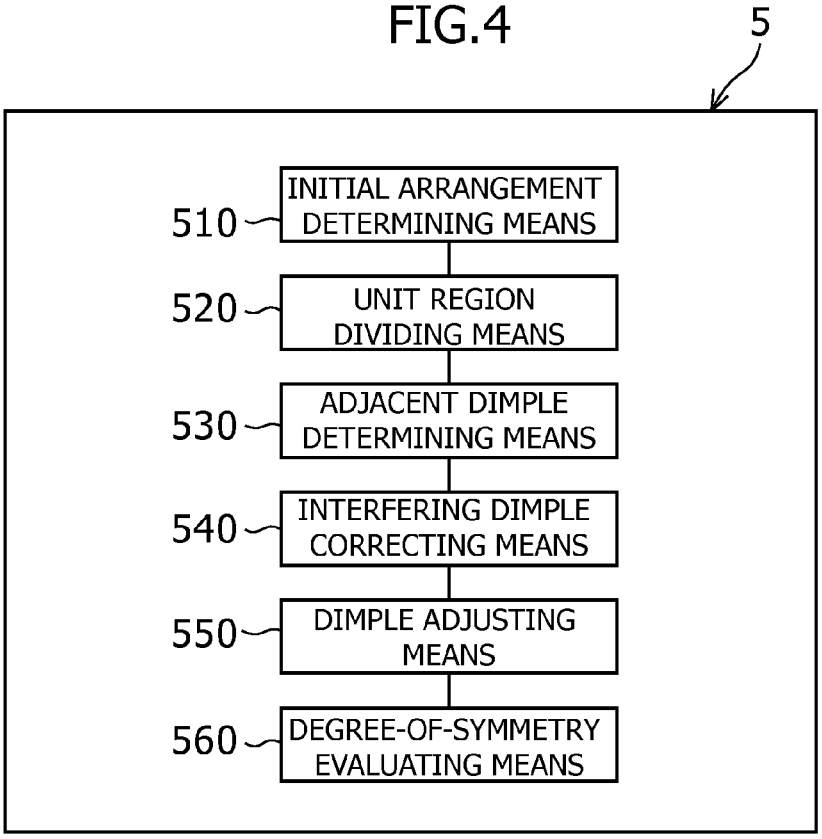
FIG. 4 is an explanatory diagram showing a functional configuration of the dimple arrangement determining apparatus.

FIG. 4 shows an example of the functional configuration of the dimple arrangement determining apparatus 5. As shown in FIG. 4, the dimple arrangement determining apparatus 5 includes an initial arrangement determining means 510, a unit region dividing means 520, an adjacent dimple determining means 530, an interfering dimple correcting means 540, a dimple adjusting means 550, and a degree-of-symmetry evaluating means 560.

Returning to FIG. 2, a flow of the processing will be described. First, the processing is started in step S1. In step S2, the initial arrangement determining means 510 determines an initial arrangement of the dimples. Upon determining the initial arrangement, a variety of known methods may be used. For example, regular octahedron arrangement is adopted in which eight virtual triangles of the same shape and size are projected onto a spherical surface of a golf ball. Alternatively, another regular polyhedron arrangement, such as a regular arrangement of icosahedrons and having rotational symmetry, may be adopted, and with a hemisphere regarded as a unit region, it is permissible to apply a method of defining the dimples on the hemisphere.

In step S3, the unit region dividing means 520 divides the spherical surface of the golf ball into multiple equivalent unit regions. Although, for example, a unit region used in the above-mentioned polyhedron arrangement may be used just as it is, it is permissible to set up other unit region regardless of the polyhedron arrangement. Here, based on the regular octahedron arrangement mentioned above, for example, the spherical surface of the golf ball is divided into eight virtual triangles projected onto the spherical surface.

In step S4, the adjacent dimple determining means 530 selects a dimple from multiple dimples in the unit region. The dimple selected at this time is called specific dimple $D_S$.

In step S5, the adjacent dimple determining means 530 obtains a between-dimples distance and a dimple interval between the specific dimple and all dimples other than the specific dimple within the unit region. If the specific dimple is located near a border of a given unit region to which the specific dimple belongs, the between-dimples distance and the dimple interval between the specific dimple and dimples located near a border of other unit regions adjacent to the given unit region are also obtained. If the specific dimple overlaps another dimple, i.e., interference occurs between the specific dimple and another dimple, the dimple interval between the two dimples becomes negative.

In step S6, the adjacent dimple determining means 530 selects such a dimple in which the dimple interval with respect to the specific dimple calculated in step S5 is equal to or less than a specific interval obtained by multiplying the radius or diameter of the specific dimple by a coefficient. The dimple selected at this time is called adjacent dimple $D_N$, which is adjacent to the specific dimple.

The coefficient for obtaining the specific interval is preferred to be approximately 1.01 to 3.00 and more preferred to be approximately 1.5 to 2.0. The initial arrangement of the dimples and the coefficient are preferred to be determined so that the between-dimples distance between the specific dimple and an adjacent dimple is approximately 0.01 to 6.0 mm and the dimple interval between the two dimples is approximately −3.0 to 6.0 mm.

In step S7, the adjacent dimple determining means 530 determines a maximum dimple interval from possible dimple intervals between the specific dimple and multiple adjacent dimples. This dimple interval is called the maximum interval.

In step S8, the adjacent dimple determining means 530 obtains an average of the dimple intervals between the specific dimple and the multiple adjacent dimples. This value is called the average interval.

In step S9, the adjacent dimple determining means 530 determines whether or not there are any dimples which are not yet selected as the specific dimple in dimples existing within the unit region. If this determination result is "YES", the procedure from steps S4 to S9 is repeated. Then, when the result of this determination of step S9 finally becomes "NO", the procedure proceeds to step S10.

In step S10, the interfering dimple correcting means 540 determines whether or not any interfering dimples exist. More specifically, whether or not among dimple intervals between two dimples adjacent to each other, any interval has a negative value, is determined. When the result of this determination is "YES", the procedure proceeds to step S11 and otherwise, the procedure proceeds to below mentioned step S13.

In step S11, the interfering dimple correcting means 540 moves the positions of the two interfering dimples. Preferably, the two dimples are moved to a position where the dimple interval between the both dimples becomes a positive value. It is more preferable to move the two dimples to a position where the dimple interval between the both dimples is substantially equal to the average distance. In the meantime, the average interval mentioned here refers to an average of the average intervals obtained in the same quantity as that of the dimples existing in the unit region obtained in step S8. Hereinafter, a term "average interval" will be used with the above-mentioned meaning in this specification.

In step S12 executed as required, the interfering dimple correcting means 540 reduces the diameter of the two interfering dimples. Preferably, the two dimples are moved to a position where the dimple intervals between them are substantially equal to the average interval. After that, until the result of the determination in step S10 turns to "NO", the procedure from steps S4 to S12 is repeated.

In step S13, the dimple adjusting means 550 moves two dimples for which the interval is the maximum to make the dimple interval substantially the same as the average interval. In the meantime, the maximum interval mentioned here refers to a maximum value of the maximum intervals obtained in the same quantity as that of the dimples in the unit region obtained in step S7. Hereinafter, the "maximum interval" will be used with the above-mentioned meaning in this specification.

In step S14 executed as required, if one of the intervals between two adjacent dimples exceeds a first threshold, the dimple adjusting means 550 increases the diameter of both dimples. The first threshold is preferred to be 0.04 mm or less and more preferred to be 0.01 mm or less.

In step S15 executed as required, the degree-of-symmetry evaluating means 560 evaluates the degree of symmetry of the arranged dimples. More specifically, when assuming an axis passing through the center of a golf ball and a product of an area $S_i$ ($1 \le i \le n$) of a virtual spherical surface of one of the dimples arranged on the spherical surface of the golf ball and a distance $L_i$ from the center of the dimple up to the axis, a summation "sum" of the products of respective dimples is calculated, where n is a quantity of the dimples arranged on the spherical surface of the golf ball. An expression for calculation of the "sum" is as follows:

$$\text{sum}=\Sigma L_n S_n$$

As the above-mentioned axis, at least two axes are prepared. By comparing the values of the summation "sum" calculated on respective axes, the degree of symmetry of the arranged dimples is evaluated. For example, a summation "sumP" calculated around a pole axis and a summation "sumS" calculated around an axis passing the seam line are obtained. The pole axis mentioned here refers to an axis passing through the north pole and the south pole of a golf ball, which are assumed when the golf ball is injection-molded in a mold. The axis passing the seam line refers to an axis passing through a certain point on the equator of the golf ball and the center of the golf ball, which are assumed when the golf ball is injection-molded in a mold.

Then, it is judged that the nearer 1.0 the "sumS"/"sumP" is, the greater the degree of symmetry the golf ball has. In contrast, it is judged that the farther from 1.0 the "sumS"/"sumP" is, the degree of symmetry of the golf ball is not greater. If it is determined that the degree of symmetry is not high, the degree of symmetry may be raised by reducing the diameter of the dimples arranged near the north pole and the south pole or the equator.

If taking an example for this circumstance, when the "sumS"/"sumP" is greater than 1.0, the sizes of the dimples arranged near the north pole and the south pole are reduced. If the "sumS"/"sumP" is less than 1.0, the sizes of the dimples arranged near the equator are reduced. With regard to a reference point as the north pole or the south pole, the word "near" expressed here means a location in a specific range of, for example, 30° to 90° north or south in latitude. This reason is that if the range is too small, the influence upon the improvement in the degree of symmetry is too low.

Furthermore, by increasing the quantity of axes for which the summation "sum" is to be obtained and following a ratio in the summation "sum" obtained about the respective axes, accuracy of evaluation on the degree of symmetry may be increased.

In step S16, the dimple adjusting means 550 determines whether or not the maximum interval is not greater than a second threshold. If the determination result is "NO", the procedure from steps S4 to S16 is repeated, and otherwise, the processing is terminated in step S17.

A transition of the changes of the initial arrangement of the dimples determined in step S2 in subsequent steps is displayed on the display unit 53. Then, a user can recognize the transition of the changes visually. The display unit 53 may display only a single unit region.

Figure 5A:
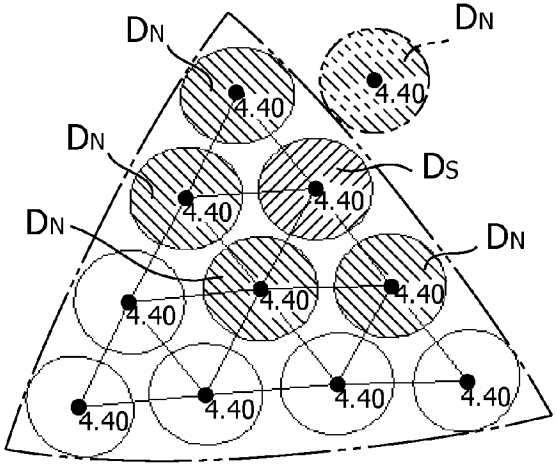
FIGS. 5A to 5C are explanatory views showing an example of transition of a screen displayed on a display screen unit.
Figure 5B:
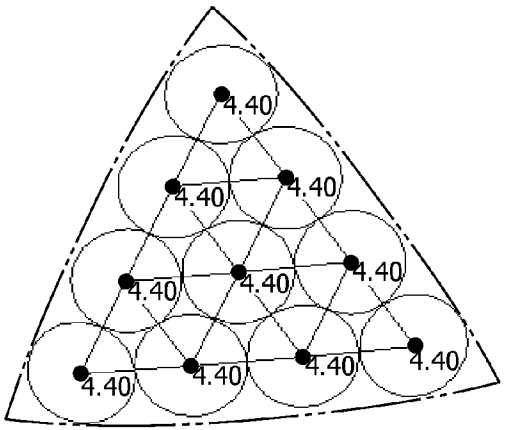
Figure 5C:
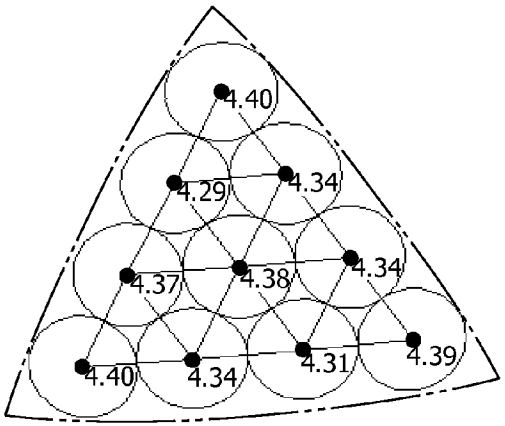

FIGS. 5A to 5C show an example of the transition of the screen when displaying only a single unit region on the display unit 53. FIG. 5A shows an example of the initial arrangement of the golf ball after step S6 is terminated. FIG. 5A shows 10 dimples within the unit region and a number "4.40" attached to each dimple indicates the diameter of the dimple in mm. If a specific dimple $D_S$ is located on the border of the unit region, the dimple outside the unit region is regarded as the adjacent dimple $D_N$.

FIG. 5B shows an example of the unit region after a session of S13 procedure is terminated, the S13 procedure being performed repeatedly multiple times. At the same time, the minimum interval (Min), the average interval (Ave) and the maximum interval (Max) of the dimple intervals are indicated. FIG. 5C shows an example of the unit region after a session of step S15 procedure is terminated, the step S15 procedure being performed repeatedly multiple times. Comparing with FIG. 5B, it is evident that the minimum interval, the average interval, and the maximum interval of the dimple intervals have all been reduced.

After the above-described dimple arrangement determining processing is terminated, preferably, the diameter of the dimple is 0.5 to 8 mm, and more preferably, it is 1.0 to 7.0 mm. The surface occupation ratio (SR) of the dimples is preferably 70% to 98% and more preferably 75% to 93%. The surface occupation ratio is calculated as follows: surface occupation ratio (SR)=(sum of planar areas of dimples)/(spherical surface area of golf ball)

An embodiment of the method for determining the dimple arrangement was described with reference to FIGS. 2 to 5C. In the arrangement of the dimples determined by executing steps S1 to S11, S13, S16 and S17 in FIG. 2, dispersion of the dimple intervals is less than in a conventional case, so that the dimples are arranged more uniformly.

Interference of the dimples which cannot be solved by step S11 can be solved by executing step S12 in FIG. 2.

By increasing the size of the dimple as required in step S14 of FIG. 2, the dimples can be arranged on the entire golf ball at a smaller dimple interval and more densely.

Additionally, the degree of symmetry of the dimples arranged on the entire golf ball can be intensified by executing step S15 of FIG. 2.

The shape of the dimple in the initial arrangement determined in step S2 of FIG. 2 may be circular or polygonal. The quantity of the dimples arranged on the entire golf ball is preferably 200 to 400, more preferably 250 to 350, and most preferably 300 to 350.

Upon executing step S14 of FIG. 2, it is permissible to use a score such that 1 point is added if the interval between two adjacent dimples is 0.05 mm or more, if it is 0.20 mm or more, 2.5 point is added, or if it is 0.40 mm or more, 5 point is added. Then, this score may be used, for example, in such a manner that if the score is point 5 or more, the size of the two dimples is increased.

The functional configuration and physical configuration of the above-mentioned dimple arrangement determining apparatus are not restricted to the above-described embodiments, but may be achieved by installing the respective functions and physical resources integrally or decentrally.

Example 1

Figure 6A:
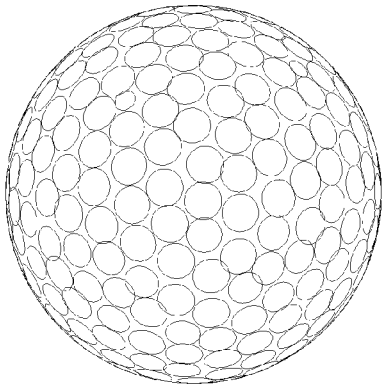
FIGS. 6A to 6D are explanatory views showing an example of changes of the arrangement of dimples.
Figure 6B:
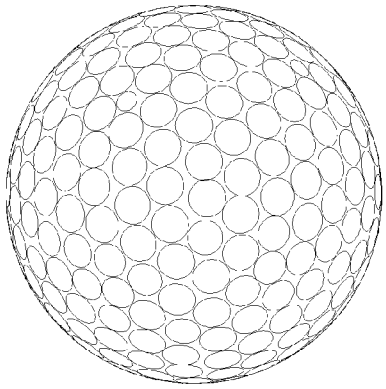
Figure 6C:
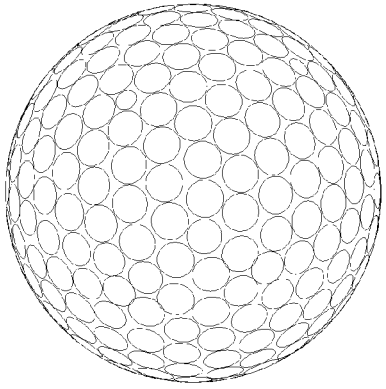
Figure 6D:
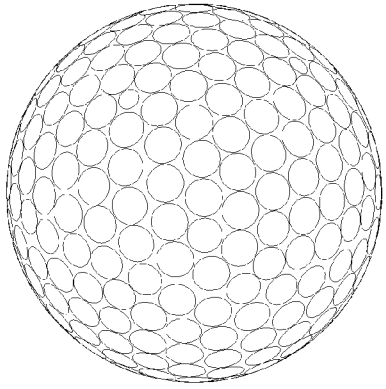

FIG. 6A shows an initial arrangement of the dimples arranged in the way of rotational-symmetry by three turns in step S2. FIGS. 6B to 6D show an example of changes of the dimples on a golf ball surface when the procedure subsequent to step S3 is executed to the initial arrangement shown in FIG. 6A. However, steps S12, S14 and S15 are not executed. That is, the dimple arrangement was calculated to attain equal dimple intervals in FIG. 6D by changing only the dimple positions without changing the dimple size.

Example 2

Figure 7A:
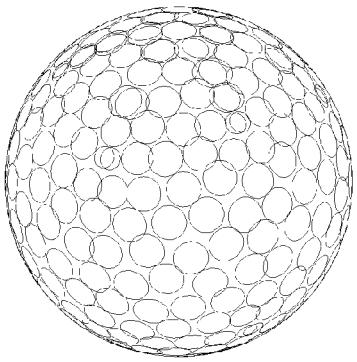
FIGS. 7A to 7F are explanatory views showing an example of changes of the arrangement of dimples.
Figure 7B:
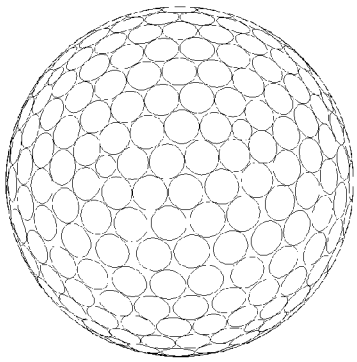
Figure 7C:
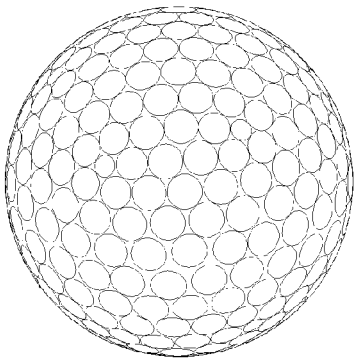
Figure 7D:
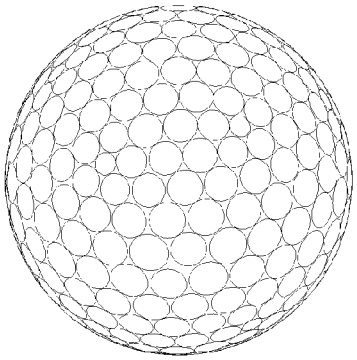
Figure 7E:
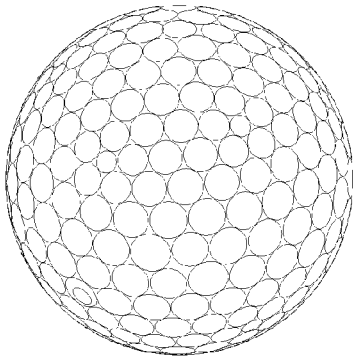

FIG. 7A shows an initial arrangement attained by, in step S2, first, designing a section corresponding to 60° under a concept on the rotational-symmetry by three turns and then, disposing remaining sections in a manner of mirror symmetry. FIGS. 7B to 7F show an example of changes of the dimples on an entire golf ball surface when the procedure subsequent to step S3 is executed as the initial arrangement shown in FIG. 7A. However, the processing of step S15 is not executed.

Figure 7F:
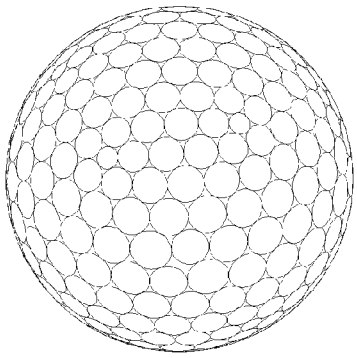
Figure 8A:
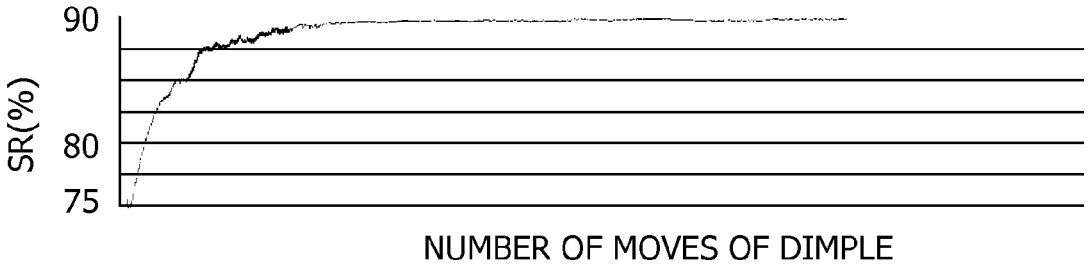
FIGS. 8A and 8B are explanatory views showing a relationship between the number of moves of the dimples and the surface occupation ratio, and a relationship between the number of moves of the dimples and dimple interval.
Figure 8B:
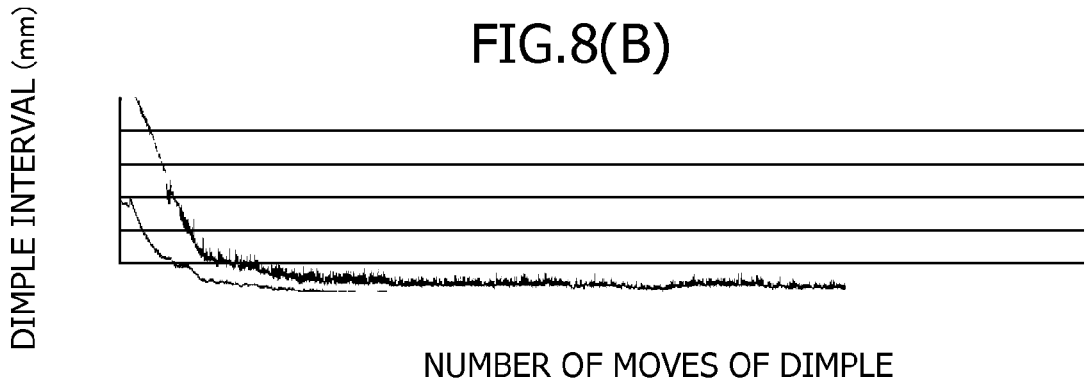

FIG. 8A shows a relationship between the number of moves of the dimple, i.e., the number of execution in step S13 in FIG. 2 and the surface occupation ratio (SR) corresponding to FIGS. 7A to 7F. FIG. 8B shows a relationship between the number of moves of the dimples and the maximum interval, and a relationship between the number of moves of the dimples and the average interval.

FIG. 7F indicates that the minimum interval (Min) of the dimple interval is 0.000 mm, the average interval (Ave) is 0.002 mm, and the maximum interval (Max) is 0.005 mm. Furthermore, this figure also indicates that the total number of dimples is 338, the surface occupation ratio (SR) is 90.06% and the average (AveR) of the diameters of the dimples is 4.39.

Example 3

Figure 9:
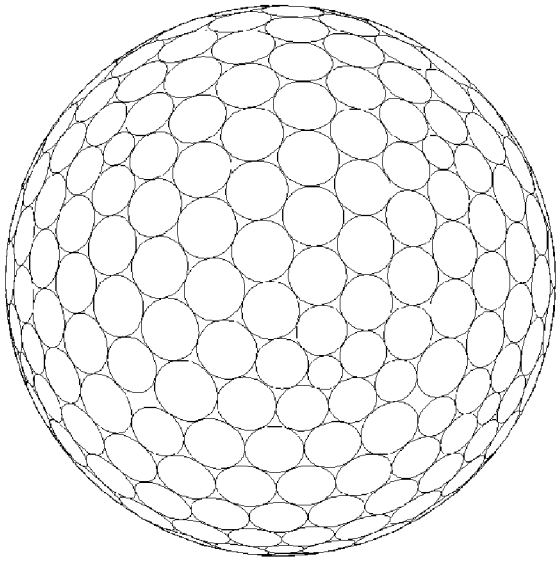
FIG. 9 is an explanatory view showing an example of the arrangement of dimples which is determined by the dimple arrangement determining processing.

FIG. 9 shows a dimple arrangement which is finally attained after the procedure including steps S12, S14, S15 is executed starting from the arrangement based on the rotational symmetry by three turns.

In this case, the total number N of the dimples is 318, the surface occupation ratio SR is 88.99% and the average of the diameter of the dimples is 4.5 mm.

Example 4

Figure 10:
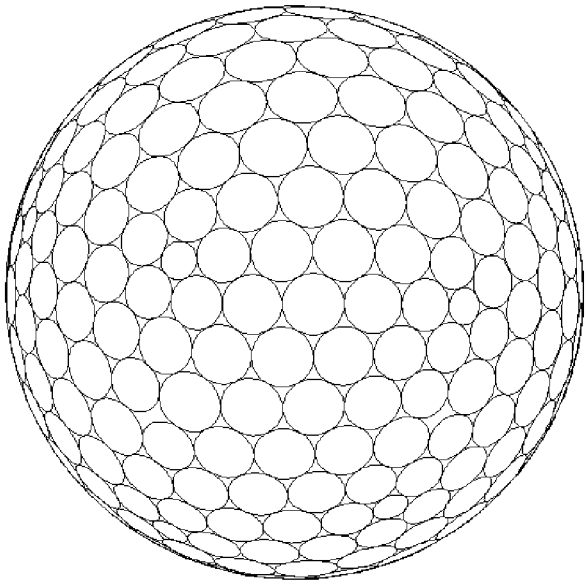
FIG. 10 is an explanatory view showing an example of the arrangement of dimples which is determined by the dimple arrangement determining processing.

FIG. 10 shows another example of a dimple arrangement attained finally after the procedure including steps S12, S14, and S15 is executed starting from the arrangement based on the rotational symmetry by three turns.

In this case, the total number N of the dimples is 330, the surface occupation ratio SR is 89.77% and the average of the diameter of the dimples is 4.43 mm.

Example 5

Figure 11:
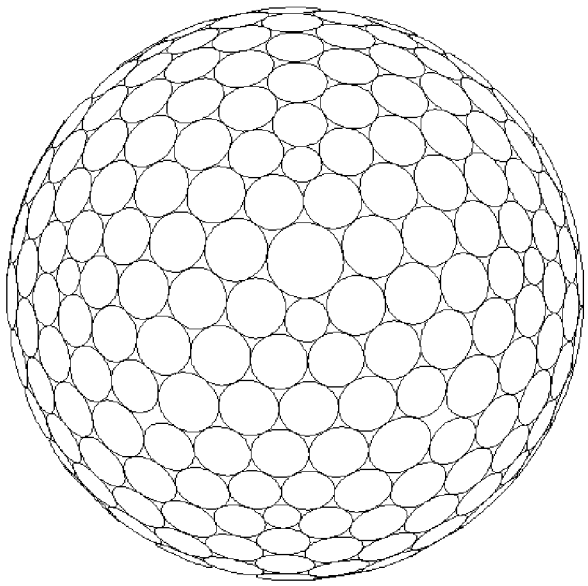
FIG. 11 is an explanatory view showing an example of the arrangement of dimples which is determined by the dimple arrangement determining processing.

FIG. 11 shows still another example of a dimple arrangement attained finally after the procedure including steps S12, S14, S15 is executed starting from the arrangement based on the rotational symmetry by three turns.

In this case, the total number N of the dimples is 334, the surface occupation ratio SR is 89.97% and the average of the diameters of the dimples is 4.35 mm.

What is claimed is:

1. A method for determining an arrangement of dimples on a golf ball surface, comprising:

an initial arrangement determining step for determining an initial arrangement of dimples on the surface of a golf ball;

a unit region dividing step for dividing the surface of a golf ball into multiple equivalent unit regions;

an adjacent relationship determining step for, based on a dimple interval between two freely selected dimples within one of the unit regions, determining whether or not the two dimples are in an adjacent relationship to each other;

a maximum interval determining step for determining a maximum interval, which is a maximum value of the dimple interval between two freely selected dimples in the adjacent relationship;

an average interval determining step for determining an average interval, which is an average of the dimple interval between two freely selected dimples in the adjacent relationship;

a position changing step of changing the initial arrangement by changing the positions of the two dimples for which the interval is the maximum to make the maximum interval substantially the same as the average interval; and a degree-of-symmetry evaluating step of selecting at least two axes passing through the center of the golf ball, acquiring a summation of products of a distance from the center of each dimple located on the golf ball up to the axis measure perpendicular to the axis, and a virtual spherical surface area of the dimple, for each axis, and based on a ratio between a summation acquired about an axis and a summation acquired about another axis, evaluating the degree of symmetry of the dimples arranged on the entire golf ball surface, wherein it is evaluated that the nearer 1.0 the ratio is, the greater the degree of symmetry, wherein the adjacent relationship determining step, the maximum interval determining step, the average interval determining step, the position changing step, and the degree-of-symmetry evaluating step are repeated until the maximum interval falls below a predetermined value.

2. The method for determining an arrangement of dimples on a golf ball surface according to claim 1, wherein when the dimple interval between the two freely selected dimples is equal to or less than a specific interval obtained by multiplying the diameter or radius of one of the dimples by a certain coefficient in the adjacent relationship determining step, it is determined that the two dimples are in an adjacent relationship with each other.

3. The method for determining an arrangement of dimples on a golf ball surface according to claim 2, wherein the coefficient by which to multiply the radius is 0.2 to 1.3.

4. The method for determining an arrangement of dimples on a golf ball surface according to claim 1, further comprising a size changing step of, after the position changing step, changing the sizes of the two dimples whose positions are already changed in the position changing step.

5. A golf ball containing arranged on a golf ball surface according to the method of claim 1.

* * * * *